US011020619B2

(12) United States Patent
Castiglione

(10) Patent No.: US 11,020,619 B2
(45) Date of Patent: Jun. 1, 2021

(54) MULTIPLE CHAMBER RESPIRATOR SEALING DEVICES AND METHODS

(71) Applicant: 3M INNOVATIVE PROPERTIES COMPANY, St. Paul, MN (US)

(72) Inventor: David M. Castiglione, Hudson, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 323 days.

(21) Appl. No.: 16/088,100

(22) PCT Filed: Mar. 15, 2017

(86) PCT No.: PCT/US2017/022451
§ 371 (c)(1),
(2) Date: Sep. 25, 2018

(87) PCT Pub. No.: WO2017/172361
PCT Pub. Date: Oct. 5, 2017

(65) Prior Publication Data

US 2019/0083823 A1 Mar. 21, 2019

Related U.S. Application Data

(60) Provisional application No. 62/313,949, filed on Mar. 28, 2016.

(51) Int. Cl.
*A62B 18/10* (2006.01)
*A62B 27/00* (2006.01)

(52) U.S. Cl.
CPC ..... *A62B 18/10* (2013.01); *A62B 27/00* (2013.01)

(58) Field of Classification Search
CPC ..... A62B 18/10; A62B 27/00; A62B 18/04; A62B 5/00; F16K 1/18; F16K 7/12
(Continued)

(56) References Cited

U.S. PATENT DOCUMENTS 2,055,853 A 9/1936 Schwartz
2,062,834 A 12/1936 Schwartz
(Continued)

FOREIGN PATENT DOCUMENTS

AU 2008202095 6/2008
CA 2402743 10/2001
(Continued)

OTHER PUBLICATIONS

"Chemical Cartridge Respirators," Koken Website, 2007 [retrieved from the Internet on Feb. 19, 2016], URL<http://www.koken-ltd.co.jp/english/chemicalcartridgerespirators.htm>, 5 pages.
(Continued)

*Primary Examiner* — Victoria Murphy
(74) *Attorney, Agent, or Firm* — Steven A. Bern; Dena M. Ehrich

(57) ABSTRACT

The present disclosure provides a respiratory protection device that includes a valve assembly operable between an open configuration and a closed configuration. In some exemplary embodiments, the respiratory protection device includes a mask body having a first air chamber, a second air chamber, and a breathable air zone. A valve assembly is operable to a closed configuration to prevent airflow from the first and second air chambers into the breathable air zone.

20 Claims, 5 Drawing Sheets

(58) Field of Classification Search
USPC ..... 128/201.22, 201.23, 201.28, 202.22, 128/202.27, 205.24, 205.25, 863
See application file for complete search history.

(56) References Cited

U.S. PATENT DOCUMENTS

| | | | |
|---|---|---|---|
| 2,168,695 | A | 8/1939 | Asari |
| 2,235,624 | A | 3/1941 | Schwartz |
| 2,787,333 | A | 4/1957 | Boone |
| 3,167,070 | A | 1/1965 | Silverman |
| 3,232,290 | A | 2/1966 | Nicolai |
| 3,594,816 | A | 7/1971 | Webb |
| 3,605,204 | A | 9/1971 | Amundsen |
| 3,703,750 | A | 11/1972 | Irwin, Jr. |
| 3,879,586 | A | 4/1975 | DuRocher |
| 3,898,700 | A | 8/1975 | Davison |
| 4,224,694 | A | 9/1980 | Palmaer |
| 4,276,657 | A | 7/1981 | Montesi |
| 4,390,765 | A | 6/1983 | Sado |
| 4,414,973 | A | 11/1983 | Matheson |
| 4,464,797 | A | 8/1984 | Glassman |
| 4,555,815 | A | 12/1985 | Walther |
| 4,562,837 | A | 1/1986 | Schlobohm |
| 4,574,799 | A | 3/1986 | Warncke |
| 4,604,509 | A | 8/1986 | Clancy |
| 4,764,989 | A | 8/1988 | Bourgeois |
| 4,790,306 | A | 12/1988 | Braun |
| 4,817,596 | A | 4/1989 | Gallet |
| 4,905,683 | A | 3/1990 | Cronjaeger |
| 4,921,512 | A | 5/1990 | Maryyanek |
| 4,932,399 | A | 6/1990 | Cappa |
| 4,981,134 | A | 1/1991 | Courtney |
| 5,062,421 | A | 11/1991 | Burns |
| 5,086,768 | A | 2/1992 | Niemeyer |
| 5,148,803 | A | 9/1992 | Schlobohm |
| 5,154,168 | A | 10/1992 | Schlobohm |
| 5,199,780 | A | 4/1993 | Ekman |
| 5,299,448 | A | 4/1994 | Maryyanek |
| 5,372,130 | A | 12/1994 | Stern |
| RE35,062 | E | 10/1995 | Brostrom |
| 5,501,213 | A | 3/1996 | Jackson |
| 5,505,197 | A | 4/1996 | Scholey |
| 5,515,846 | A | 5/1996 | Drews |
| 5,540,218 | A | 7/1996 | Jones |
| 5,555,569 | A | 9/1996 | Lane |
| 5,579,761 | A | 12/1996 | Yuschak |
| 5,592,935 | A | 1/1997 | Elstran |
| 5,611,925 | A | 3/1997 | Yasue |
| 5,647,356 | A | 7/1997 | Osendorf |
| 5,647,357 | A | 7/1997 | Barnett |
| 5,659,296 | A | 8/1997 | Debe |
| 5,666,663 | A | 9/1997 | Bolle |
| 5,666,949 | A | 9/1997 | Debe |
| 5,669,375 | A | 9/1997 | Dahrendorf |
| 5,687,767 | A | 11/1997 | Bowers |
| 5,732,695 | A | 3/1998 | Metzger |
| 5,803,076 | A | 9/1998 | Myers |
| 5,924,420 | A | 7/1999 | Reischel |
| 5,937,439 | A | 8/1999 | Barthold |
| 5,937,857 | A | 8/1999 | Caterini |
| 5,940,891 | A | 8/1999 | Lane |
| 5,967,142 | A | 10/1999 | Dorcheh |
| 5,975,079 | A | 11/1999 | Hellings |
| 6,016,802 | A | 1/2000 | Jackson |
| 6,016,804 | A | 1/2000 | Gleason |
| 6,167,882 | B1 | 1/2001 | Almqvist |
| 6,196,223 | B1 | 3/2001 | Belfer |
| 6,206,003 | B1 | 3/2001 | Burch |
| 6,216,693 | B1 | 4/2001 | Rekow |
| 6,269,814 | B1 | 8/2001 | Blaszczykiewicz |
| 6,298,849 | B1 | 10/2001 | Scholey |
| 6,345,620 | B2 | 2/2002 | Salapow |
| 6,408,845 | B1 | 6/2002 | Pereira |
| 6,418,928 | B1 | 7/2002 | Bordewick |
| 6,460,539 | B1 | 10/2002 | Japuntich |
| 6,470,886 | B1 | 10/2002 | Jestrabek-Hart |
| 6,490,729 | B1 | 12/2002 | Dondero |
| 6,550,479 | B1 | 4/2003 | Duxbury |
| 6,575,165 | B1 | 6/2003 | Cook |
| 6,584,976 | B2 | 7/2003 | Japuntich |
| 6,659,102 | B1 | 12/2003 | Sico |
| 6,701,925 | B1 | 3/2004 | Resnick |
| 6,712,072 | B1 | 3/2004 | Lang |
| 6,732,733 | B1 | 5/2004 | Brostrom |
| 6,761,169 | B2 | 7/2004 | Eswarappa |
| 6,793,702 | B2 | 9/2004 | Eswarappa |
| 6,817,362 | B2 | 11/2004 | Gelinas |
| 6,854,464 | B2 | 2/2005 | Mukaiyama |
| 6,874,499 | B2 | 4/2005 | Viner |
| 6,883,518 | B2 | 4/2005 | Mittelstadt |
| 6,886,559 | B2 | 5/2005 | McDonald |
| 6,928,657 | B2 | 8/2005 | Bell |
| 6,997,206 | B1 | 2/2006 | Klockseth |
| 7,025,060 | B1 | 4/2006 | Nicholson |
| 7,059,326 | B2 | 6/2006 | Heidmann |
| 7,100,608 | B2 | 9/2006 | Brewer |
| 7,101,412 | B2 | 9/2006 | Gossweiler |
| 7,114,496 | B1 | 10/2006 | Resnick |
| 7,118,608 | B2 | 10/2006 | Lovell |
| 7,121,279 | B2 | 10/2006 | Dennis |
| 7,158,822 | B2 | 1/2007 | Payne, Jr. |
| RE39,493 | E | 2/2007 | Yuschak |
| 7,171,966 | B2 | 2/2007 | Schrader |
| 7,188,622 | B2 | 3/2007 | Martin |
| 7,213,595 | B2 | 5/2007 | Capon |
| 7,296,568 | B2 | 11/2007 | Capon |
| 7,302,951 | B2 | 12/2007 | Mittelstadt |
| 7,320,722 | B2 | 1/2008 | Mittelstadt |
| 7,353,826 | B2 | 4/2008 | Sleeper |
| 7,419,526 | B2 | 9/2008 | Greer |
| 7,464,705 | B2 | 12/2008 | Tanizawa |
| 7,543,584 | B2 | 6/2009 | Brookman |
| 7,559,323 | B2 | 7/2009 | Hacke |
| 7,584,751 | B1 | 9/2009 | Brooks, Jr. |
| 7,587,929 | B2 | 9/2009 | Zielinski |
| 7,650,884 | B2 | 1/2010 | Flannigan |
| 7,669,599 | B2 | 3/2010 | Gunaratnam |
| 7,762,258 | B2 | 7/2010 | Zollinger |
| 7,827,990 | B1 | 11/2010 | Melidis |
| 7,836,886 | B2 | 11/2010 | McDonald |
| 7,849,856 | B2 | 12/2010 | Mittelstadt |
| 7,866,010 | B2 | 1/2011 | Schmidtke |
| 7,866,319 | B2 | 1/2011 | Penton |
| 7,908,668 | B2 | 3/2011 | Folkesson |
| 7,997,275 | B2 | 8/2011 | Quinn |
| 8,006,691 | B2 | 8/2011 | Kenyon |
| 8,011,368 | B2 | 9/2011 | Crutchfield |
| 8,015,626 | B2 | 9/2011 | Grassl |
| 8,066,006 | B2 | 11/2011 | Daugaard |
| 8,069,853 | B2 | 12/2011 | Tilley |
| 8,104,472 | B2 | 1/2012 | Henderson |
| 8,118,026 | B2 | 2/2012 | Gebrewold |
| 8,176,918 | B2 | 5/2012 | Teng |
| 8,266,724 | B2 | 9/2012 | Grilliot |
| 8,267,088 | B2 | 9/2012 | Steindorf |
| 8,272,382 | B2 | 9/2012 | Howard |
| 8,291,906 | B2 | 10/2012 | Kooij |
| 8,312,876 | B2 | 11/2012 | Mutze |
| 8,327,850 | B2 | 12/2012 | Ng |
| 8,336,547 | B1 | 12/2012 | Ritchie |
| 8,342,180 | B2 | 1/2013 | Martin |
| 8,365,771 | B2 | 2/2013 | Xue |
| 8,402,966 | B2 | 3/2013 | Morgan, III |
| 8,402,971 | B2 | 3/2013 | Scheiner |
| 8,443,806 | B2 | 5/2013 | Morelli |
| 8,460,423 | B2 | 6/2013 | Legare |
| 8,496,005 | B2 | 7/2013 | McDonald |
| 8,505,536 | B2 | 8/2013 | Kielow |
| 8,528,559 | B2 | 9/2013 | Crutchfield |
| 8,550,084 | B2 | 10/2013 | Ng |
| 8,573,201 | B2 | 11/2013 | Rummery |
| 8,631,792 | B2 | 1/2014 | Ho |
| 8,678,003 | B2 | 3/2014 | Darkin |
| 8,708,708 | B1 | 4/2014 | Carideo |

(56) References Cited

U.S. PATENT DOCUMENTS

| | | | |
|---|---|---|---|
| 8,720,443 | B2 | 5/2014 | Kooij |
| 8,770,195 | B2 | 7/2014 | Stone |
| 8,839,788 | B2 | 9/2014 | Betz |
| 9,095,800 | B2 | 8/2015 | Symons |
| 9,149,669 | B2 | 10/2015 | Cowell |
| 2001/0013347 | A1 | 8/2001 | Rekow |
| 2002/0195108 | A1 | 12/2002 | Mittelstadt |
| 2002/0195109 | A1 | 12/2002 | Mittelstadt |
| 2003/0200969 | A1 | 10/2003 | Kintzel |
| 2003/0217752 | A1 | 11/2003 | Muller |
| 2004/0003810 | A1 | 1/2004 | Templeton |
| 2004/0025880 | A1 | 2/2004 | Capon |
| 2005/0085799 | A1 | 4/2005 | Luria |
| 2005/0126572 | A1 | 6/2005 | Gosweiler |
| 2006/0076012 | A1 | 4/2006 | Tanizawa |
| 2006/0225738 | A1 | 10/2006 | Afentoulopoulos |
| 2006/0283453 | A1 | 12/2006 | Haddad |
| 2006/0283455 | A1 | 12/2006 | Walker |
| 2007/0157439 | A1 | 7/2007 | Schmidtke |
| 2007/0272169 | A1 | 11/2007 | Barney |
| 2008/0135050 | A1 | 6/2008 | Hitchcock |
| 2008/0178884 | A1 | 7/2008 | Gerson |
| 2008/0245364 | A1 | 10/2008 | Patterson |
| 2009/0000624 | A1 | 1/2009 | Lee |
| 2009/0044808 | A1 | 2/2009 | Guney |
| 2009/0065729 | A1 | 3/2009 | Worboys |
| 2009/0078264 | A1 | 3/2009 | Martin |
| 2009/0107515 | A1 | 4/2009 | Gavriely |
| 2009/0139526 | A1 | 6/2009 | Melidis |
| 2009/0188506 | A1 | 7/2009 | Duke |
| 2009/0217926 | A1 | 9/2009 | Hine |
| 2009/0235934 | A1 | 9/2009 | Martin |
| 2009/0250060 | A1 | 10/2009 | Hacke |
| 2009/0266361 | A1 | 10/2009 | Bilger |
| 2009/0268153 | A1 | 10/2009 | Wang-Lee |
| 2010/0108067 | A1 | 5/2010 | Walker |
| 2010/0132714 | A1 | 6/2010 | Morelli |
| 2010/0206311 | A1 | 8/2010 | Flannigan |
| 2010/0218761 | A1 | 9/2010 | Flannigan |
| 2010/0224194 | A1 | 9/2010 | Walker |
| 2010/0269833 | A1 | 10/2010 | Gillotin |
| 2010/0307506 | A1 | 12/2010 | Kielow |
| 2010/0313891 | A1 | 12/2010 | Veliss |
| 2010/0319701 | A1 | 12/2010 | Connell |
| 2011/0000481 | A1 | 1/2011 | Gumaste |
| 2011/0100372 | A1 | 5/2011 | Betz |
| 2011/0240027 | A1 | 10/2011 | Billingsley |
| 2011/0290253 | A1 | 12/2011 | McAuley |
| 2011/0314595 | A1 | 12/2011 | Kobayashi |
| 2012/0000465 | A1 | 1/2012 | Cavaliere |
| 2012/0024289 | A1 | 2/2012 | Johnstone |
| 2012/0042878 | A1 | 2/2012 | Woo |
| 2012/0080035 | A1 | 4/2012 | Guney |
| 2012/0167890 | A1 | 7/2012 | Insley |
| 2012/0168658 | A1 | 7/2012 | Insley |
| 2012/0174922 | A1 | 7/2012 | Virr |
| 2012/0199130 | A1 | 8/2012 | Euvrard |
| 2012/0204879 | A1 | 8/2012 | Cariola |
| 2012/0234326 | A1 | 9/2012 | Mazzone |
| 2012/0260920 | A1 | 10/2012 | Choi |
| 2013/0004358 | A1 | 1/2013 | Underwood, Jr. |
| 2013/0104900 | A1 | 5/2013 | Tobias |
| 2013/0125896 | A1 | 5/2013 | Dwyer |
| 2013/0133628 | A1 | 5/2013 | Fornara |
| 2013/0133664 | A1 | 5/2013 | Startare |
| 2013/0180523 | A1 | 7/2013 | Huggins |
| 2013/0186394 | A1 | 7/2013 | Hallett |
| 2013/0199520 | A1 | 8/2013 | Dhuper |
| 2013/0228184 | A1 | 9/2013 | Lee |
| 2013/0239972 | A1 | 9/2013 | McAuley |
| 2013/0269513 | A1 | 10/2013 | Estirado Vera |
| 2013/0298775 | A1 | 11/2013 | Fiet |
| 2013/0319420 | A1 | 12/2013 | Danford |
| 2013/0327323 | A1 | 12/2013 | Rubin |
| 2014/0007888 | A1 | 1/2014 | Sanchez Talero |
| 2014/0076325 | A1 | 3/2014 | Rosert |
| 2014/0096768 | A1 | 4/2014 | Lee |
| 2014/0096774 | A1 | 4/2014 | Olsen |
| 2014/0109301 | A1 | 4/2014 | Hall |
| 2014/0190476 | A1 | 7/2014 | Stinton |
| 2014/0216447 | A1 | 8/2014 | Kihlberg |
| 2014/0216472 | A1 | 8/2014 | Brace |
| 2014/0216473 | A1 | 8/2014 | Dwyer |
| 2014/0216474 | A1 | 8/2014 | Mittelstadt |
| 2014/0216475 | A1 | 8/2014 | Blomberg |
| 2014/0216476 | A1 | 8/2014 | Brace |
| 2014/0251327 | A1 | 9/2014 | Mittelstadt |
| 2014/0261437 | A1 | 9/2014 | Catanzarite |
| 2014/0345607 | A1 | 11/2014 | Skov |
| 2015/0107596 | A1 | 4/2015 | Mashiko |
| 2015/0136142 | A1 | 5/2015 | Blomberg |

FOREIGN PATENT DOCUMENTS

| | | |
|---|---|---|
| CN | 1040508 | 3/1990 |
| CN | 2800855 | 8/2006 |
| CN | 102233160 | 11/2011 |
| CN | 202364901 | 8/2012 |
| CN | 203194645 | 9/2013 |
| CN | 203235112 | 10/2013 |
| CN | 203290282 | 11/2013 |
| CN | 203467742 | 3/2014 |
| CN | 103977513 | 6/2014 |
| CN | 104544685 | 4/2015 |
| CN | 204306113 | 5/2015 |
| DE | 2645008 | 4/1978 |
| DE | 10057473 | 5/2002 |
| DE | 202014105242 | 6/2015 |
| EP | 2017508 | 1/2009 |
| FR | 2607916 | 6/1988 |
| FR | 2854575 | 11/2004 |
| FR | 2903864 | 1/2008 |
| FR | 2906670 | 4/2008 |
| GB | 472897 | 9/1937 |
| GB | 591531 | 8/1947 |
| GB | 861574 | 2/1961 |
| GB | 1048258 | 11/1966 |
| GB | 1511303 | 5/1978 |
| GB | 2388787 | 11/2003 |
| GB | 2472835 | 2/2011 |
| JP | 0418581 | 4/1992 |
| JP | 6099947 | 4/1994 |
| JP | 11151312 | 6/1999 |
| JP | 2001-104364 | 4/2001 |
| JP | 2001-104501 | 4/2001 |
| JP | 2006-346269 | 12/2006 |
| JP | 2011-055896 | 3/2011 |
| JP | 2011-246860 | 12/2011 |
| JP | 5610274 | 12/2011 |
| JP | 2012-040336 | 3/2012 |
| KR | 100773460 | 11/2007 |
| KR | 2012-0000355 | 1/2012 |
| WO | 2002-093045 | 11/2002 |
| WO | 2003-090873 | 11/2003 |
| WO | 2003-099385 | 12/2003 |
| WO | 2006-114505 | 11/2006 |
| WO | 2006-129028 | 12/2006 |
| WO | 2006-135231 | 12/2006 |
| WO | 2008-082415 | 7/2008 |
| WO | 2008-134905 | 11/2008 |
| WO | 2010-095168 | 8/2010 |
| WO | 2012-100116 | 7/2012 |
| WO | 2013-187278 | 12/2013 |
| WO | 2013-187279 | 12/2013 |
| WO | 2014-120500 | 8/2014 |
| WO | 2014-120527 | 8/2014 |
| WO | 2014-120597 | 8/2014 |
| WO | 2015-073414 | 5/2015 |

(56) References Cited

FOREIGN PATENT DOCUMENTS

| | | |
|---|---|---|
| WO | 2017-172358 | 10/2017 |
| WO | 2017-172510 | 10/2017 |

OTHER PUBLICATIONS

"Particulate Respirators," Koken Website, 2007 [retrieved from the Internet on Feb. 19, 2016] URL<http://www.kokenltd.co.jp/english/particulaterespirators.htm>, 4 pages.

"Respirator Set / Options," Koken Website, 2007 [retrieved from the Internet on Jun. 28, 2016] URL<http://www.koken-ltd.co.jp/english/respiratorset.htm>, 2 pages.

International Search Report for PCT International Application No. PCT/US2017/022451, dated Jun. 8, 2017, 2 pages.

MULTIPLE CHAMBER RESPIRATOR SEALING DEVICES AND METHODS

CROSS REFERENCE TO RELATED APPLICATIONS

This application is a national stage filing under 35 U.S.C. 371 of PCT/US2017/022451, filed Mar. 15, 2017, which claims the benefit of U.S. Provisional Application No. 62/313,949, filed Mar. 28, 2016, the disclosure of which is incorporated by reference in its/their entirety herein.

TECHNICAL FIELD

This disclosure describes respiratory protection devices and methods including fit check devices, and in some embodiments, respiratory protection devices including multiple air chambers.

BACKGROUND

Respirator protection devices that cover a user's nose and mouth, for example, and provide breathable air to a wearer are well known. Air is drawn through a breathable air source by a wearer or forced by a fan or blower into a breathing zone where the air may be inhaled by the wearer.

In order to effectively deliver breathable air to a wearer, respiratory protection devices prevent unfiltered air from entering the mask. Various techniques have been proposed for testing the integrity of a face seal, for example, of a respiratory protection device. In a positive pressure test, an exhalation valve of the respiratory protection device is blocked while the wearer exhales into the mask. An adequate seal may be signaled by an increased internal pressure due to an inability of air to exit the mask if a leak is not present. Alternatively, negative pressure tests have been proposed in which a filter cartridge port is blocked while a wearer inhales while wearing the mask. An adequate seal may be signaled by a reduced internal pressure due to the inability of air to enter the mask if a leak is not present. Various mechanisms have been provided for blocking one or more ports to facilitate a negative or positive pressure test.

SUMMARY

Particular embodiments described herein provide a respiratory protection device including a mask body defining a first chamber, a second chamber, and a breathable air zone for a wearer. First and second breathing air source components are configured for attachment to the mask body such that the first chamber is in fluid communication with the first breathing air source component and the second chamber is in fluid communication with the second breathing air source component. A valve assembly comprising a single actuator is operable between an open configuration and a closed configuration in which fluid communication between the first and second breathing air source components and the breathable air zone is prevented. The first and second chambers are substantially fluidically isolated such that the first chamber is in fluid communication with the breathable air zone through a first inhalation port and the second chamber is in fluid communication with the breathable air zone through a second inhalation port.

Embodiments can include any, all, or none of the following features. The first and second inhalation ports may include a check valve configured to allow air to enter the breathable air zone and to prevent exit of air from the breathable air zone into the first or second chambers. A single diaphragm may selectively cover both the first inhalation port and the second inhalation port that is configured to allow air to enter the breathable air zone from the first and second chambers and prevent exit of air from the breathable air zone to the first or second chambers. The mask body may include a central plane that divides the mask body into left and right halves, and the first and second chambers may be separated by a wall oriented at least partially parallel to the central plane. At least portions of the valve assembly may travel within the first and second air chambers when the valve assembly is operated between the open and closed configurations. The valve assembly may include a unitary plunger, with portions of the unitary plunger traveling on each side of a separation wall between the first and second air chambers when the valve assembly is operated between the open and closed configurations. The unitary plunger may move linearly along a longitudinal axis extending along a central plane that divides the mask body into left and right halves. The respiratory protection device may include first and second elastomeric seals. The first breathing air source component may be in sealing engagement with the first elastomeric seal when attached to the mask body and the second breathing air source component may be in sealing engagement with the second elastomeric seal when attached to the mask body. The valve assembly may include first and second sealing surfaces and the first and second inhalation ports may include corresponding sealing surfaces, and in the closed configuration the first sealing surface of the valve assembly contacts the sealing surface of the first inhalation port and the second sealing surface of the valve assembly contacts the sealing surface of the second inhalation port. The actuator may be a button that is depressed when the valve assembly is in the closed configuration. The valve assembly may be biased towards the open configuration. The valve assembly may include first and second sealing surfaces configured to prevent air flow through the first and second air chambers. The first and second sealing surfaces may be configured to move linearly between the open and closed configurations.

Particular embodiments described herein provide a method of operating a respiratory protection device including operating a valve assembly from an open configuration, in which a mask body provides a first flow path through a first chamber between a first breathing air source component and a breathable air zone and a second flow path through a second chamber between a second breathing air source component and the breathable air zone, to a closed configuration in which fluid communication through the first and second flow paths is prevented. The first chamber is not in fluid communication with the second chamber, and the valve assembly comprises a single actuator movable from the open configuration to the closed configuration.

Embodiments can include any, all, or none of the following features. The method may further include inhaling while the valve assembly is in the closed configuration. The method may further including assessing a fit of the mask body based on an indication observed while inhaling. The indication may be increased difficulty inhaling. The mask body may include a compliant face contacting portion, and the indication may be an inward deflection of the compliant face contacting portion. The method may further include releasing the actuator to allow the valve assembly to return to the open configuration.

Particular embodiments described herein provide a respiratory protection device including a mask body defining a first chamber, a second chamber, and a breathable air zone for a wearer. First and second breathing air source components are configured for attachment to the mask body such that the first chamber is in fluid communication with the first breathing air source component and the second chamber is in fluid communication with the second breathing air source component. A valve assembly includes a single actuator operable between an open configuration and a closed configuration in which fluid communication between the first breathing air source component and the breathable air zone is prevented. The first and second chambers are substantially fluidically isolated such that the first chamber is in fluid communication with the breathable air zone through a first inhalation port and the second chamber is in fluid communication with the breathable air zone through a second inhalation port.

Embodiments can include any, all, or none of the following features. Fluid communication between the second breathing air source component and the breathable air zone may be prevented in the closed configuration. The first and second inhalation ports may include a check valve configured to allow air to enter the breathable air zone and to prevent exit of air from the breathable air zone into the first or second chambers. A single diaphragm may selectively cover both the first inhalation port and the second inhalation port and may be configured to allow air to enter the breathable air zone from the first and second chambers and prevent exit of air from the breathable air zone to the first or second chambers. At least portions of the valve assembly may travel within the first and second air chambers when the valve assembly is operated between the open and closed configurations. The valve assembly may include a unitary plunger, and portions of the unitary plunger may travel on each side of a separation wall between the first and second air chambers when the valve assembly is operated between the open and closed configurations.

The details of one or more embodiments are set forth in the accompanying drawings and the description below. The above summary is not intended to describe each disclosed embodiment or every embodiment. Other features and advantages will be apparent from the description and drawings, and from the claims.

DESCRIPTION OF DRAWINGS

The present description is further provided with reference to the appended Figures, wherein like structure is referred to be like numerals throughout the several views, and wherein.

While the above-identified figures set forth various embodiments of the disclosed subject matter, other embodiments are also contemplated. In all cases, this disclosure presents the disclosed subject matter by way of representation and not limitation.

DETAILED DESCRIPTION OF ILLUSTRATIVE EMBODIMENTS

The present disclosure provides a respiratory protection device including a mask body defining a breathable air zone for a wearer configured to receive one or more breathing air source components. The respiratory protection device includes a valve assembly selectively operable between an open position in which breathable air may pass from the breathing air source components into the breathable air zone, and a closed position in which airflow is blocked. In some exemplary embodiments, the respiratory protection device includes a first chamber and a second chamber in fluid communication with the breathable air zone and that are substantially fluidically isolated from one another. Breathable air may be delivered to the breathable air zone independently through each of the first and second air chambers without substantial mixing of air received from the first and second breathing air source components before entering the breathable air zone.

Figure 1:
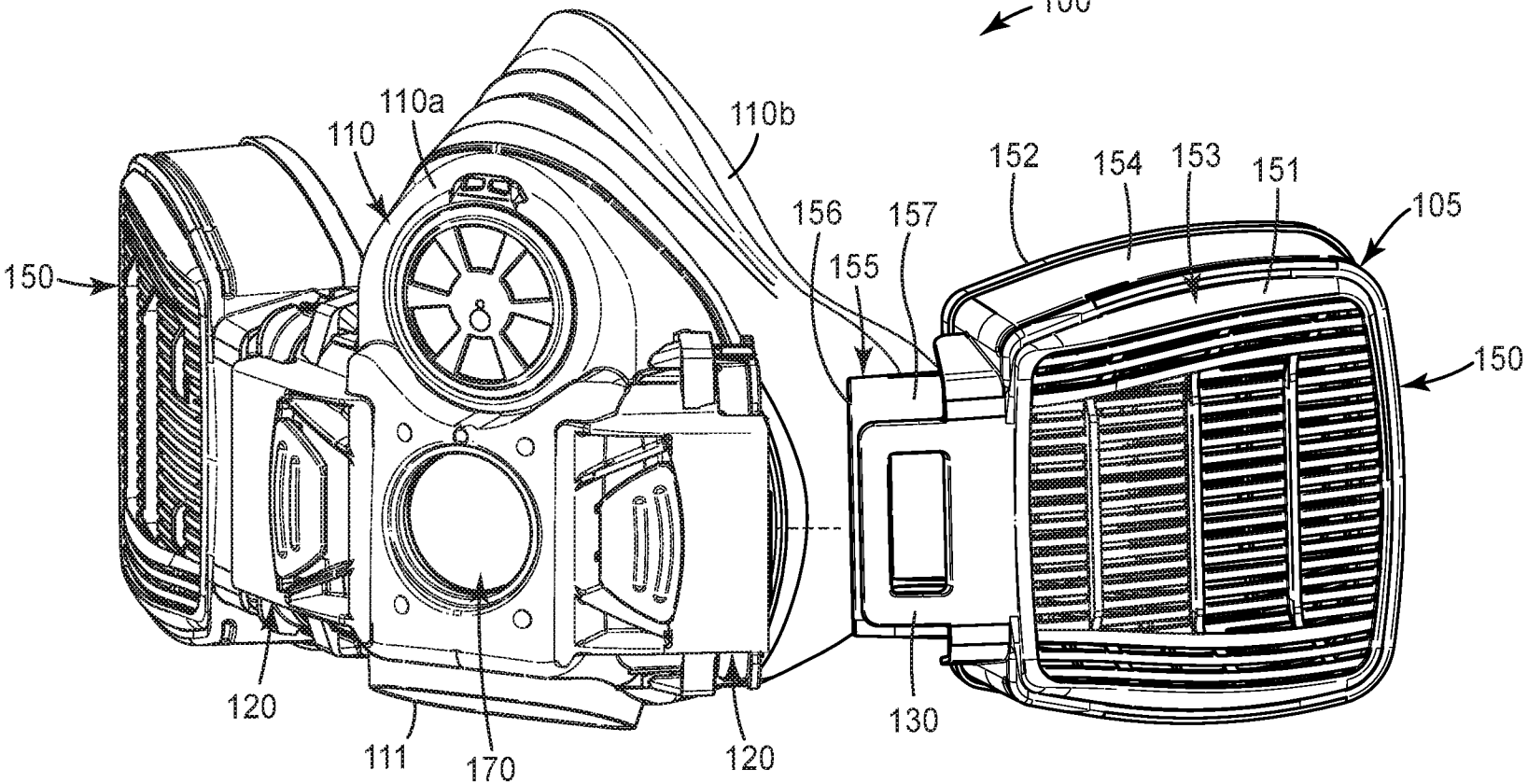
FIG. 1 is a perspective view of an exemplary respiratory protection device.

Referring to FIG. 1, an exemplary respiratory protection device 100 is shown that covers the mouth and/or nose of a wearer. Respiratory protection device 100 includes a mask body 110 having one or more receivers 120. One or more breathing air source components 150 may be attached to mask body 110 at the one or more receivers 120. First and second breathing air source components 150 may include filter cartridges that filter air received from the external environment before the air enters a breathable air zone of the mask body. In other exemplary embodiments, first and second breathing air source components 150 may include a supplied air component, such as a tube or conduit, powered air purifying respirator component, or other appropriate breathing air source component 150.

Mask body 110 may include a rigid or semi-rigid portion 110*a* and a compliant face contacting portion 110*b*. Compliant face contacting portion 110*b* includes a flexible material allowing mask body 110 to be comfortably supported over a person's nose and mouth and/or provide an adequate seal with the face of a wearer. Face contacting member 110*b* may have an inturned cuff to facilitate a comfortable and snug fit over the wearer's nose and against the wearer's cheeks. Rigid or semi-rigid portion 110*a* may provide structural integrity to mask body 110. In various exemplary embodiments, mask body portions 110*a*, 110*b* may be provided integrally or as one or more separately formed portions that are subsequently joined together in permanent or removable fashion.

Mask body 110 includes an exhalation port 111 that allows air to be purged from an interior space within mask body 110 during exhalation by the wearer. In an exemplary embodiment, exhalation valve is located centrally on mask body 110. An exhalation valve, including a diaphragm or check valve, for example, selectively allows air to exit due to positive pressure within mask body 110, while preventing ingress of external air. In some exemplary embodiments, exhalation port 111 is positioned at a relatively lower portion of the mask body, for example below the mouth of a wearer.

A harness or other support assembly (not shown in FIG. 1) may be provided to support mask body 110 in position over the mouth and/or nose of a wearer. In an exemplary embodiment, a harness includes one or more straps that pass behind a wearer's head and/or may be attached to a crown member or a headwear suspension supported on a wearer's head, for example.

One or more breathing air source components 150, such as filter cartridges, may be attached to mask body 110 at first and second receivers 120. In an exemplary embodiment, first and second receivers 120 are positioned on opposite sides of mask body 110, proximate check portions of mask body 110, for example. First and second receivers 120 include complementary mating features such that filter cartridges may be securely attached to mask body 110. The mating features may provide a removable connection such that the first and second filter cartridges may be removed and replaced at the end of their service life or if use of a different breathing air source component is desired. Alternatively, the connection may be permanent so that the filter cartridge cannot be removed without damage to the filter cartridge.

A breathing air source component 150 may be secured to receiver 120 by one or more latches, threads, connectors, or complementary features, for example. In an exemplary embodiment, respiratory protection device 100 includes a cantilever latch 130 that secures breathing air source component 150 to receiver 120 of mask body 110. Cantilever latch 130 may be integral with breathing air source component 150, and substantially parallel and/or at least partially co-extending with a nozzle element 155. Receiver 120 and/or mask body 110 may include one or more complementary mating features that cooperate with cantilever latch 130 to provide a secure connection between body 110 and breathing air source component 150. In other exemplary embodiments, receiver 120 and/or mask body 110 may include a cantilever latch 130 that cooperates with a feature of breathing air source component 150, and cantilever latch 130 and/or a complementary mating feature may deflect to result in secure engagement.

Breathing air source component 150, such as a filter cartridge 105, may filter ambient air, for example, before the air passes into an interior space of mask body 110. In an exemplary embodiment, filter cartridge 105 includes a body portion 153 including first and second major surfaces 151, 152, and may include one or more sidewalls 154 extending at least partially between first and second major surfaces 151, 152. One or more of the first and second major surfaces 151, 152 and/or sidewall are at least partially fluid permeable to allow air to enter filter cartridge 105. In some exemplary embodiments, filter cartridge 105 may include primarily filter media without an outer housing or surrounded partially by a housing.

Filter cartridge 105 includes an outlet nozzle 155 to allow fluid to exit filter cartridge 105 into mask body 110. In an exemplary embodiment, outlet nozzle 155 extends outwardly from body portion 153, such as sidewall 154, and includes a leading end 156, an outer surface 157 and an inner surface defining an airflow channel through outlet nozzle 155. In various exemplary embodiments, outlet nozzle 155 may be positioned proximate any of first or second major surfaces 151, 152, one or more sidewalls 154, or a combination thereof.

Filter cartridge 105 is secured to mask body 110 at least in part by engaging with receiver 120. In an exemplary embodiment, outlet nozzle 155 is inserted into an opening of receiver 120 defined in part by an elastomeric seal (not shown in FIG. 1). A rigid outer portion of receiver 120, for example, may provide primary structural support and stability between mask body 110 and filter cartridge 105, and the elastomeric seal may sealingly engage outer surface 157 and/or other portions of outlet nozzle 155 and filter cartridge 150 to prevent ingress of contaminants or debris from an external environment.

Respiratory protection device 100 includes a valve assembly 170 having one or more components to selectively prevent airflow from one or more breathing air source components 150 to the breathable air zone of mask body 110. Valve assembly 170 is operable between a closed configuration in which fluid communication between one or more breathing air source components 150 are blocked, and an open configuration in which breathable air may flow from breathing air source components 150 to the breathable air zone of mask body 110, as described in greater detail herein.

Referring to FIGS. 2-5, an exemplary respiratory protection device 200 is shown. Respiratory protection device 200 includes a mask body 210 (portions of which are omitted in FIGS. 2-5) defining a breathable air zone 211, and in some embodiments may be similar to respiratory protection device 100 described above. Respiratory protection device 200 includes a first air chamber 213, a second air chamber 214, and a valve assembly 270 that selectively blocks airflow through the first and second air chambers. A wearer may operate valve assembly 270 to selectively prevent airflow from one or more breathing air source components to the breathable air zone to perform a fit test.

Figure 2:
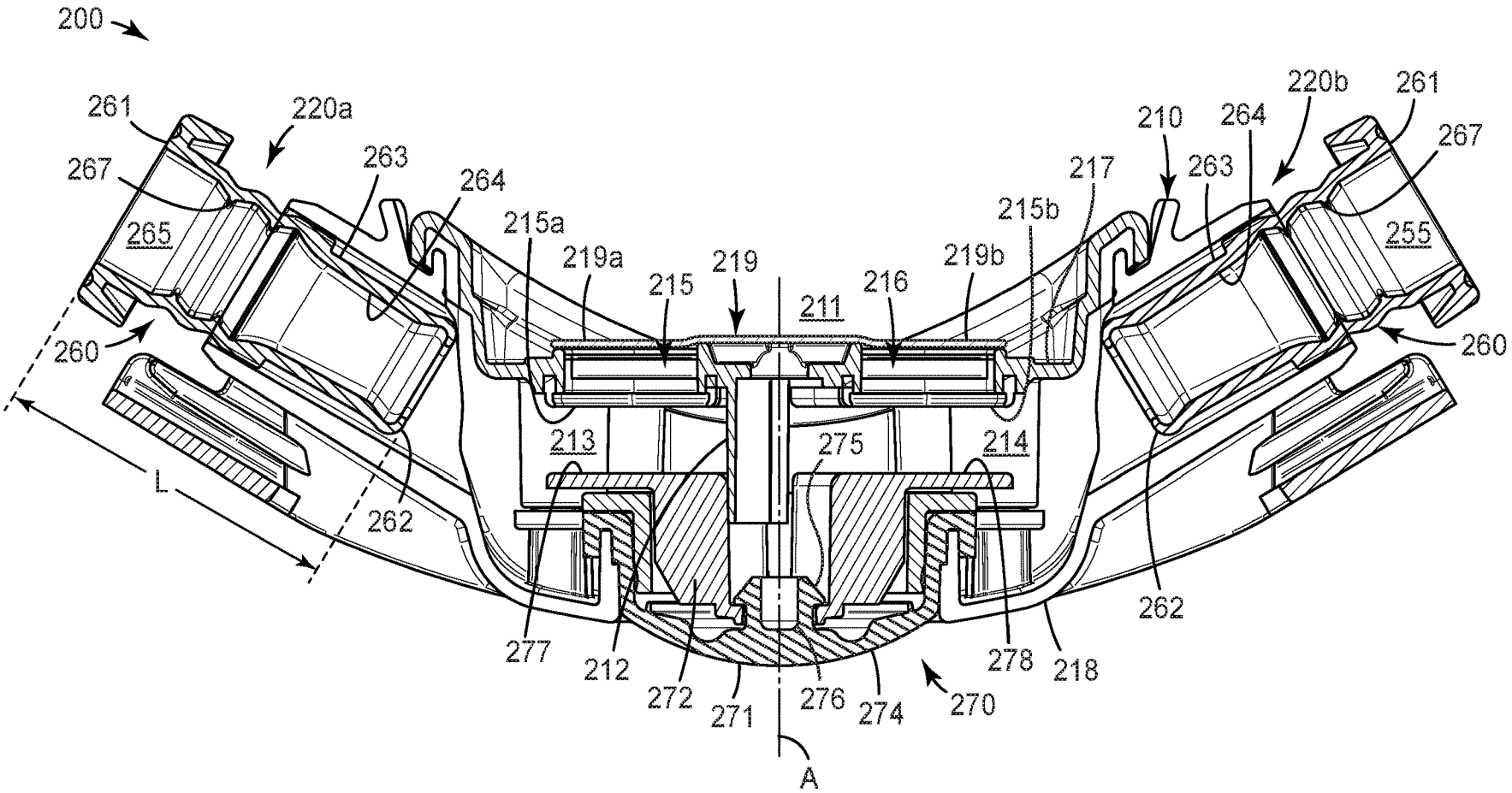
FIG. 2 is a partial cross-sectional view of an exemplary respiratory protection device.

FIG. 2 shows a partial cross-sectional view of exemplary respiratory protection device 200 including a first air chamber 213 and second air chamber 214 in selective fluid communication with breathable air zone 211. Breathable air may enter mask body 210 at first receiver 220*a*, flow through first air chamber 213, and pass through a first inhalation port 215 into breathable air zone 211. Similarly, breathable air may enter mask body 210 at second receiver 220*b*, flow through second air chamber 214, and pass through a second inhalation port 216 into breathable air zone 211.

In an exemplary embodiment, breathable air from first and second breathing air source components remains substantially unmixed until after entering breathable air zone 211. Breathable air may flow through first and second air chambers 213, 214 and into breathable air zone 211 relatively independently. Independent flow of air from first and second breathing air sources may promote controlled flow through mask body 210 and/or reduce turbulent mixing of air that could be associated with increased pressure drop through the mask body and increased breathing resistance. Substantially independent air flow paths to breathable air zone 211 through first and second air chambers 213, 215 may thus reduce pressure drop through the mask body and reduce breathing resistance.

Furthermore, first and second air chambers 213, 214 that deliver air to breathable air zone 211 substantially independently allow flexibility in the configuration and positioning of receivers 220, inhalation ports 215, 216, and/or other components of mask body 210. In an exemplary embodiment, receivers 220 are positioned at substantially opposite sides of mask body such that air flows through first and second air chambers 213, 214, respectively, in substantially opposite, or otherwise different, directions towards first and second inhalation ports. Because air chambers 213, 214 are substantially fluidically isolated, interaction between air flowing in different directions from first and second breathing air source components that could result in turbulent air flow and associated resistance is reduced.

First and second air chambers 213, 214 may be defined by one or more components of mask body 210 and exhibit an appropriate shape to provide air flow between a breathing air source component attached to mask body 210 and breathable air zone 211. For example, first chamber 213 is defined at least in part by interior wall 217 and an outer wall 218 of mask body 210. First air chamber 213 is substantially sealed from the external environment, except for air that may enter through a first receiver 220 from a first breathing air source component, and exit through first inhalation port 215 into breathable air zone 211. Second chamber 214 may similarly be defined at least in part by interior wall 217 and an outer wall 218 of mask body 210, and may be substantially sealed from the external environment, except for air that may enter through a second receiver 220 from a second breathing air source component, and exit through second inhalation port 216 into breathable air zone 211.

A separation wall 212 may divide first and second air chambers 213, 214. In some exemplary embodiments, separation wall 212 may be a common separation wall such that first and second air chambers 213, 214 are positioned directly on opposing sides of separation wall 212. Separation wall 212 may be centrally located, and for example may be positioned at least partially along and/or parallel to a central plane dividing mask body 210 into left and right halves. Separation wall 212 may extend substantially across an entire distance between interior wall 217 and actuator and/or plunger 271 of valve assembly 270 to substantially fluidically isolate first and second air chambers 213, 214.

A mask body having a breathable air zone defined at least in part by interior wall 217 of mask body 210, and first and second air chambers 213, 214 defined at least in part by interior wall 217 of the mask body and/or positioned outwardly from breathable air zone 211, provides multiple air chambers that may be substantially fluidically isolated while minimizing extra bulk or weight. Further, mask body 210 may be configured to have an outer wall 218 that is close to the wearer's face and does not result in an unduly large moment of inertia that could be perceived to cause discomfort.

Each of first and/or second air chambers 213, 214 may provide a duct to direct air from one or more breathing air source components to the first and second inhalation ports 215, 216, respectively. First and second air chambers 213, 214 allow receivers 220 and inhalation ports 215, 216 to be independently positioned at different locations of mask body 210. For example, receivers 220 may be positioned near cheek positions and/or rearward of an outermost front portion of mask body 210, while inhalation ports 215, 216 may be positioned proximate a central axis extending centrally through mask body 210. In some exemplary embodiments, such a configuration allows breathing air source components, such as filter cartridges, to extend rearwardly along a wearer's face to promote a center of mass close to the wearer, and to reduce the presence of breathing air source components within the wearer's field of vision.

Interior wall 217 may at least partially define first and second air chambers 213, 214 and include first and second inhalation ports 215, 216 extending through interior wall 217. First and second inhalation ports 215, 216 include an inhalation valve that selectively allows fluid communication into breathable air zone 211 from first and second air chambers 213, 214, respectively. In an exemplary embodiment, the inhalation valve includes a flap or diaphragm 219. Diaphragm 219 may be secured at a central location, between first and second inhalation ports 215, 216, for example, by one or more pins or flanges, at a peripheral edge, or other appropriate location. Diaphragm 219 is biased towards engagement with interior wall 217, for example a perimeter of openings defined by first and/or second inhalation ports 215, 216, to selectively allow passage of air into breathable air zone 211. When pressure in the breathable air zone is greater than first and/or second air chambers 213, 214, such as during exhalation, diaphragm 219 remains urged in sealing engagement with interior wall 217 so that air cannot exit breathable air zone 211 through inhalation ports 215, 216. When pressure in the breathable air zone is less than first and/or second air chambers 213, 214, such as during inhalation, diaphragm 219 may deflect or open to allow air to flow from first and/or second air chambers 213, 214 into breathable air zone 211. In an exemplary embodiment, diaphragm 219 includes a single, integral diaphragm 219 including first and second diaphragm portions 219*a*, 219*b* associated with an opening defined by the first and second inhalation ports 215, 216, respectively. In some exemplary embodiments, diaphragm 219 includes a first diaphragm 219*a* and a second diaphragm 219*b* that is separate and independent from first diaphragm 219*a*.

Respiratory protection device 200 may include one or more elastomeric seals 260 that promotes a sealed connection between mask body 210 and a breathing air source component. Elastomeric seal 260 may include an O-ring, gasket, sealing sleeve, or other appropriate seal. In an exemplary embodiment, elastomeric seal 260 receives a portion of a breathing air source component, such as a nozzle or outlet, and includes a first end portion 261, a second end portion 262, an outer surface 263 and an inner surface 264 at least partially defining a channel 265. First end portion 261 may be connected to a rigid component of a mask body, such as receiver 220. In an exemplary embodiment, elastomeric seal 260 provides an elastomeric sleeve that at least partially surrounds an outer surface of a breathing air source component, such as a filter cartridge 250, attached to mask body 210, and has a length (L) between first and second ends such that at least a portion of a breathing air source component 250 may be positioned within channel 265. In some exemplary embodiments, length (L) may be between 5 mm and 100 mm, 10 mm and 40 mm, or about 20 mm. Second end portion 262 and/or various locations of elastomeric seal 260 may be floating or otherwise not anchored to a rigid component of mask body 210 such that elastomeric seal 260 may move or deform at least partially independently of a portion of mask body 210, while first end portion 261 is anchored and/or rigidly secured with a component of mask body 210 (not shown in FIG. 2).

Figure 3:
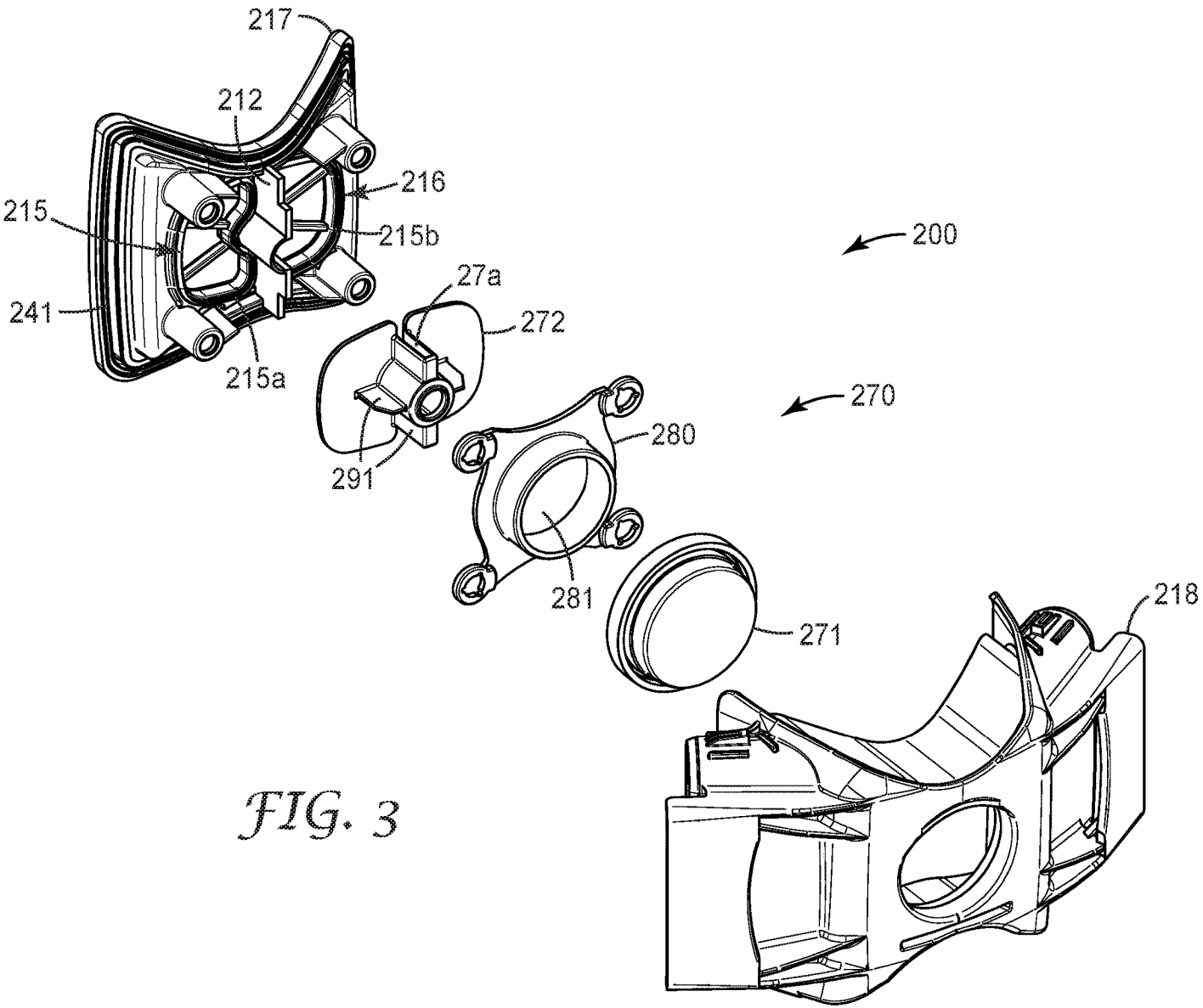
FIG. 3 is a partial exploded view of the respiratory protection device of FIG. 2.

Referring to FIGS. 2-3, respiratory protection device 200 includes a valve assembly 270 operable between open and closed configurations including an actuator 271 and a plunger 272 having one or more sealing surfaces, such as sealing surfaces 277, 278. Actuator 271 is operable by a user to move valve assembly 270 between the open and closed configurations. Actuator 271 may be a button, such as an over-molded elastomeric push-button, slidable button, or the like, that may be pressed inward or otherwise operated to move plunger 272. For example, actuator 271 may be pressed inwardly to cause plunger 272 to move towards first and second inhalation ports 215, 216. In various exemplary embodiments, actuator 271 may alternatively or additionally include a twist mechanism, lever, slider, or other appropriate actuator 271 operable to move valve assembly between open and closed configurations. In some embodiments, valve assembly 270 may be supported at least partially between outer wall 218 and/or a front portion of mask body 210 that engages or is integral with a rear portion of mask body 210, such as interior wall 217, that at least partially defines breathable air zone 211.

In an exemplary embodiment, valve assembly 270 includes an actuator 271 that is operable to move valve assembly 270 into a closed configuration in which air flow from two or more breathing air source components is prevented from entering breathable air zone 211 of mask body 210. For example, operation of actuator 271 may cause sealing surfaces of plunger 272 to sealingly engage complementary sealing surfaces of first and second inhalation ports 215, 216. Plunger 272 may have a first sealing surface 277 configured to sealingly engage a complementary first sealing surface 215*a* of first inhalation port 215, and a second sealing surface 278 configured to sealingly engage a complementary second sealing surface 216*a* of second inhalation port 216. In an open configuration, sealing surfaces 277, 278 of plunger 272 are spaced from inhalation ports 215, 216 and complementary sealing surfaces 215*a*, 216*a*. In the closed configuration, first and second sealing surfaces 277, 278 of plunger 272 sealingly engage complementary sealing surfaces 215*a*, 216*a*, to prevent airflow from first and second chambers 215, 216 into breathable air zone 211. Alternatively or additionally, valve assembly 270 may prevent airflow by sealing engagement with elastomeric seal 260, receiver 220, or other component of mask body 210 to prevent airflow from first and/or second breathing air source components to breathable air one 211.

Sealing surfaces 215*a*, 216*a* of first and second inhalation ports 215, 216 facilitate consistent sealing engagement with complementary sealing surfaces of valve assembly 270, such as sealing surfaces 277, 278, without requiring a user to exert excessive force on actuator 271. In an exemplary embodiment, sealing surfaces 215*a*, 216*a* of first and second inhalation ports 215, 216 may include a raised surface, rib, flange, or the like, that surround first and second openings defined by first and second inhalation ports 215, 216, respectively, and promote consistent contact. Sealing surfaces 277, 278 of plunger 272 and/or sealing surfaces 215*a*, 216*a* of first and second inhalation ports 215, 216 may include a compliant or resilient material to promote consistent sealing. For example, first and second sealing surfaces 215*a*, 216*a* may include an elastomeric gasket or flange extending from interior wall 217. The gasket or flange may flex or bend when contacted by plunger 272 to promote consistent engagement around an entire perimeter of sealing surfaces 215*a*, 216*a*. Alternatively or in addition, sealing surfaces 277, 278 of plunger 272 may include a compliant or resilient material such that sealing surfaces 277, 278 may flex and/or rotate or articulate with contact against sealing surfaces 215*a*, 216*a*. Sealing surfaces including one or more compliant or resilient portions may promote consistent sealing engagement over a range of plunger displacements and orientations that may vary, for example, based on a force on actuator 271 applied by a user or broad dimensional tolerances of valve assembly 270 and other components of respiratory protection device 200.

FIG. 3 shows a partial exploded view of exemplary respiratory protection device 200. First and second inhalation ports 215, 216 are positioned on interior wall 217. Interior wall 217 may be integral to or assembled with one or more other portions of mask body 210. For example, interior wall 217 may include one or more seals 241 to provide air tight sealing engagement with outer wall 218 or another portion of mask body 210.

In an exemplary embodiment, valve assembly 270 includes a guide 280 that maintains alignment of sealing surfaces 277, 278 between open and closed configurations. Guide 280 may be positioned between actuator 271 and plunger 272, and interact with complementary features of plunger 272 during movement between open and closed positions. For example, plunger 272 may have one or more tabs 291 defining a width that fits within an opening 281 of guide 280 and maintains plunger 272 and/or sealing surfaces in appropriate alignment.

Valve assembly 270 may include a unitary plunger 272 defining sealing surfaces 277, 278, or include one or more components defining sealing surfaces 277, 278. In an exemplary embodiment, plunger 272 is configured to at least partially receive and/or travel over interior wall 212. For example, plunger 272 includes a channel 279 that separation wall 212 may at least partially reside within when valve assembly 270 moves between open and closed configurations, such that portions of plunger 272 may travel on each side of separation wall 212 when the valve assembly is operated between the open and closed configurations. Valve assembly 270 may thus be configured to close first and second inhalation ports 215, 216 located at first and second air chambers 213, 214, that are substantially fluidically isolated from one another, by operating a single actuator 271. Accordingly, a wearer may readily perform a fit text of respiratory protection device 200 having multiple breathing air source components by operation of a single actuator 271.

Figure 4:
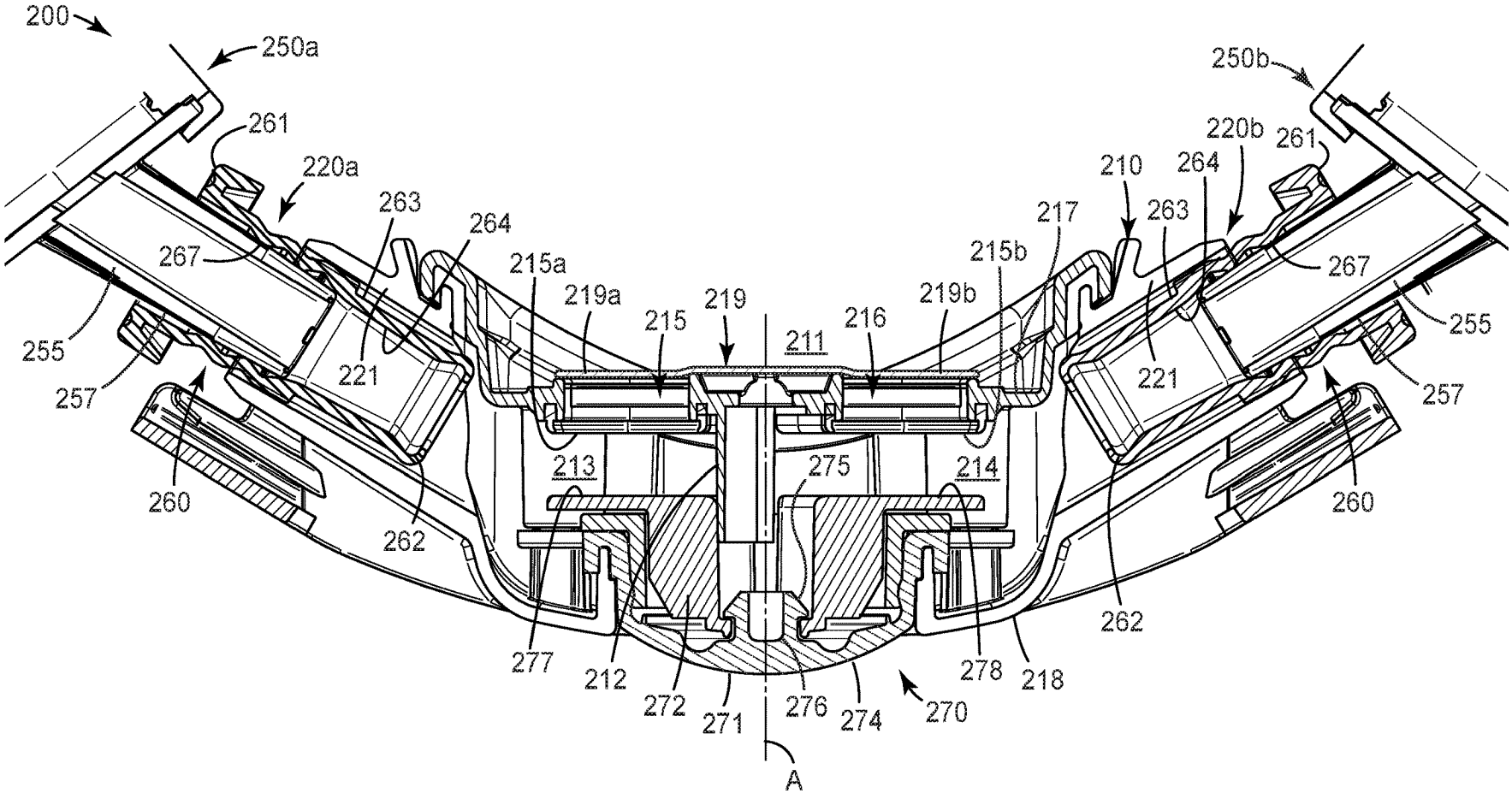
FIG. 4 is a partial cross-sectional view of the respiratory protection device of FIG. 2 including first and second breathing air source components.
Figure 5:
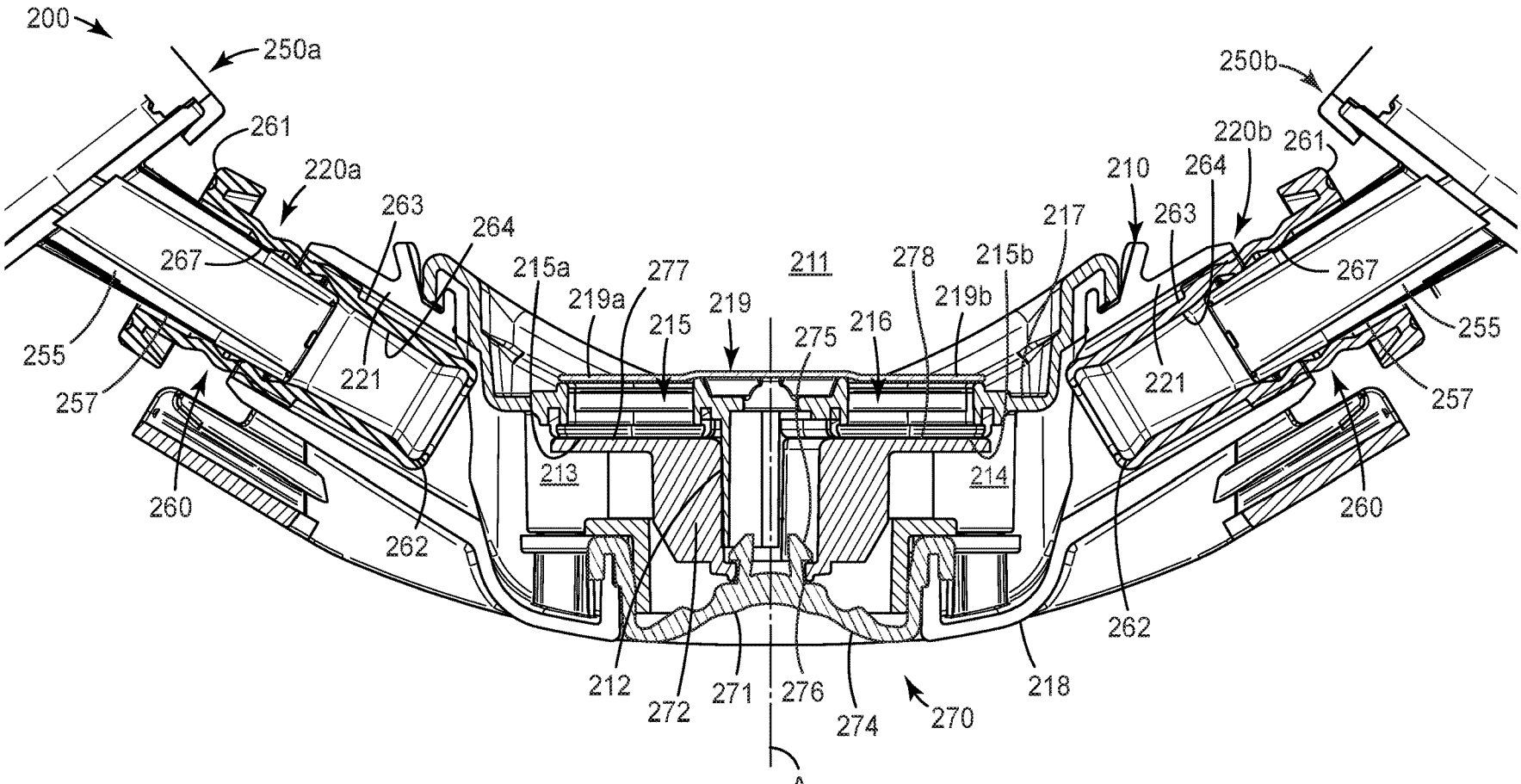
FIG. 5 is a partial cross-sectional view of the respiratory protection device of FIG. 2 showing a valve assembly in a closed configuration.

Referring to FIGS. 4 and 5, partial cross-sectional views are shown of respiratory protection device 200 including first and second breathing air source components attached to first and second receivers 220 with valve assembly 270 in an open configuration (FIG. 4) and a closed configuration (FIG. 5). In the open configuration, air may flow from a first breathing air source component, such as first filter cartridge 250*a*, into first air chamber 213, and through first inhalation port 215 into breathable air zone 211, and from a second breathing air source component, such as second filter cartridge 250*b*, into second air chamber 214, and through second inhalation port 216 into breathable air zone 211. In a closed configuration shown in FIG. 5, sealing surfaces 277, 278 of valve assembly 270 are in sealing engagement with complementary sealing surfaces of first and second inhalation ports 215, 216. Alternatively or in addition, sealing surfaces 277, 278 may contact second end portion 262 of first and second elastomeric seals 260, or another component of mask body 210, to substantially prevent fluid communication between first and second breathing air source components and breathable air zone 211.

Receiver 220 is configured such that outlet nozzle 255 of filter cartridge 250 may slide into a channel 265 defined by elastomeric seal 260. Outer surface 257 of outlet nozzle 255 contacts inner surface 264 of elastomeric seal 260 to provide sealing engagement between filter cartridge 250 and receiver 220. A rigid outer portion 221 of receiver 220 may provide substantial structural support and stability between mask body 210 and filter cartridge 250 while engagement between elastomeric seal 260 and filter cartridge 250 provides an adequate seal to prevent ingress of unwanted contaminants or debris from the external environment.

In an exemplary embodiment, outer surface 257 of outlet nozzle 255 may be relatively larger than channel 265 defined by inner surface 264 to promote an interference fit and a snug sealing engagement between outlet nozzle 255 and elastomeric seal 260. Alternatively or in addition, elastomeric seal 260 may include sections of varying wall thickness and/or having a contoured shape. For example, inner surface 264 may include one or more ribs 267 positioned at a location configured to contact outer surface 257 of outlet nozzle 255. One or more ribs 267 promote continuous contact around a perimeter of outlet nozzle to provide an adequate seal. Furthermore, one or more ribs 267 may provide an area of concentrated pressure between outlet nozzle 255 and elastomeric seal 260 that may promote robust sealing without requiring excessive force by a user when engaging filter cartridge 250 with receiver 220.

A wearer of respiratory protection device 200 may perform a fit test by positioning mask body 210 in a position of use over a mouth and/or nose and operating valve assembly 270. For example, with mask body 210 in a position of use, and one or more filter cartridges 250 engaged to mask body 210, valve assembly 270 may be operated from the open configuration to the closed configuration. Operation of actuator 271, by pressing actuator 271 inwardly, for example, causes plunger 272 to move from the open position (FIG. 4) to the closed configuration (FIG. 5), while portions of valve assembly 270 are on each side of separation wall 212. In the closed configuration, sealing surfaces 277, 278 of plunger 272 are in sealing engagement with complementary sealing surfaces 215*a*, 216*a* of first and second inhalation ports 215, 216.

Operation of valve assembly 270 from the open configuration to the closed configuration allows a user to perform a fit test to confirm a desired seal is formed between mask body 210 and the user's face, for example, by providing an indicator of the presence and/or absence of a leak that may be observed by the wearer. When valve assembly 270 is in the closed configuration, air is prevented from entering breathable air zone 211 from first and second air chambers 215, 216. Inhalation by a wearer in the closed configuration thus creates a negative pressure within mask body 210, and may cause increasingly greater difficulty for the user to further inhale. Alternatively or additionally, inhalation in the closed configuration may cause a compliant face contacting portion, such as compliant face contacting portion 110*b* (FIG. 1), to deflect inwardly if a seal is formed with the user's face. If an adequate seal is not achieved, a negative pressure may not be created and associated indicators of an adequate seal may not be present. Accordingly, operation of valve assembly 270 to the closed configuration, followed by inhalation by the user, provides an indication of whether a seal is formed between respiratory protection device 200 and the user's face.

Actuator 271 and/or plunger 272 may be configured to move linearly along a longitudinal axis between open and closed configurations. For example, actuator 271 and/or plunger 272 may move linearly between open and closed configurations along a longitudinal axis (A) extending centrally through actuator 271 and/or plunger 272. Longitudinal axis (A) may extend orthogonal to an outer surface of actuator 271. In some exemplary embodiments, longitudinal axis (A) passes substantially centrally through actuator 271 and plunger 272, and between first and second inhalation ports 280.

First and/or second sealing surfaces 277, 278 may similarly move linearly along an axis of travel between open and closed configurations, and guide 280 may maintain appropriate alignment with first and second inhalation ports 215, 216 to result in sealing engagement in the closed configuration. Alternatively or in addition, actuator 271 and/or plunger 272 may travel along a shaft or rail positioned along longitudinal axis (A) or parallel and spaced from longitudinal axis (A). In some embodiments, actuator 271 and/or plunger 272 may "float" or be supported substantially by flexible web 274 of actuator 271. Flexible web 274 may maintain actuator 271 and/or plunger 272 in substantial alignment with longitudinal axis (A) during movement between open and closed configurations, and maintain sealing surfaces in position for appropriate alignment with first and second inhalation ports 215, 216, and/or other component of mask body 110, to selectively prevent air flow from first and second air chambers 213, 214 to breathable air zone 211. Alternatively or in addition, actuator 271, plunger 272 and/or sealing surfaces 277, 278 may pivot, rotate, or travel at least partially along a non-linear path between open and closed configurations.

Valve assembly 270 may be biased to return to a desired configuration in the absence of an applied force by a user. For example, valve assembly 270 includes one or more resilient members that return valve assembly 270 to an open configuration (FIG. 4) when released by a user. In an exemplary embodiment, actuator 271 is an elastomeric button that acts as a resilient member biasing plunger 272 towards the open configuration in which sealing surfaces 277, 278 are out of sealing engagement with complementary sealing surfaces 215*a*, 216*a* of first and second inhalation ports 215, 216. Actuator 271 may include a flexible web 274 attached to an outer wall 218 or other rigid component of mask body 210 to support actuator 271 and bias actuator 271 to the open configuration. Web 274 is formed of a flexible or compliant material that is able to elastically deform when actuator is pressed inwardly by a user, while acting to return valve assembly 270 to the open configuration in the absence of an applied force by the user. Alternatively or additionally, valve assembly 270 may include one or more resilient members. In various exemplary embodiments, a coil spring, leaf spring, or elastomeric band, for example, may be provided to bias valve actuator 271 and/or plunger 272 towards the open position.

Actuator 271 and plunger 272 may be connected, directly or indirectly, to facilitate operation between the open and closed configurations. In an exemplary embodiment, plunger 272 has greater rigidity or stiffness compared to actuator 271. Actuator 271 and plunger 272 may be joined by a snap-fit connector 275 of actuator 271 positioned through an aperture 276 of plunger 272. Alternatively or in addition, actuator 271 and plunger 272 may be joined by rivets, mechanical fasteners, adhesive, or one or more intermediate components, for example. A substantially rigid plunger 272 may facilitate robust sealing engagement with a substantially flexible or compliant second end portion 262 of elastomeric seal 260. In some exemplary embodiments, actuator 271 and plunger 272 are joined such that guide 280 is positioned between actuator 271 and plunger 272.

The foregoing detailed description and examples have been given for clarity of understanding only. No unnecessary limitations are to be understood there from. It will be apparent to those skilled in the art that many changes can be made in the embodiments described without departing from the scope of the disclosure. Any feature or characteristic described with respect to any of the above embodiments can be incorporated individually or in combination with any other feature or characteristic, and are presented in the above order and combinations for clarity only. Thus, the scope of the present disclosure should not be limited to the exact details and structures described herein. Moreover, although features may be described herein as acting in certain combinations and/or initially claimed as such, one or more features from a claimed combination can in some cases be excised from the combination, and the claimed combination may be directed to a subcombination or variation of a subcombination.

What is claimed is:

1. A respiratory protection device, comprising:

a mask body defining a first chamber, a second chamber, and a breathable air zone configured for a wearer;

first and second breathing air source components configured for attachment to the mask body such that the first chamber is in fluid communication with the first breathing air source component and the second chamber is in fluid communication with the second breathing air source component; and a valve assembly comprising a single actuator operable between an open configuration and a closed configuration in which fluid communication between the first and second breathing air source components and the breathable air zone is prevented;

wherein the first and second chambers are fluidically isolated such that the first chamber is in fluid communication with the breathable air zone through a first inhalation port and the second chamber is in fluid communication with the breathable air zone through a second inhalation port.

2. The respiratory protection device of claim 1, wherein the first and second inhalation ports comprise a check valve configured to allow air to enter the breathable air zone and to prevent exit of air from the breathable air zone into the first or second chambers.

3. The respiratory protection device of claim 1, wherein a single diaphragm selectively covers both the first inhalation port and the second inhalation port and is configured to allow air to enter the breathable air zone from the first and second chambers and prevent exit of air from the breathable air zone to the first or second chambers.

4. The respiratory protection device of claim 1, wherein the mask body comprises a central plane that divides the mask body into left and right halves, and the first and second chambers are separated by a wall oriented at least partially parallel to the central plane.

5. The respiratory protection device of claim 1, wherein at least portions of the valve assembly travels within the first and second air chambers when the valve assembly is operated between the open and closed configurations.

6. The respiratory protection device of claim 5, wherein the valve assembly comprises a unitary plunger, and portions of the unitary plunger travel on each side of a separation wall between the first and second air chambers when the valve assembly is operated between the open and closed configurations.

7. The respiratory protection device of claim 6, wherein the unitary plunger moves linearly along a longitudinal axis extending along a central plane that divides the mask body into left and right halves.

8. The respiratory protection device of claim 1, comprising first and second elastomeric seals, wherein the first breathing air source component is in sealing engagement with the first elastomeric seal when attached to the mask body and the second breathing air source component is in sealing engagement with the second elastomeric seal when attached to the mask body.

9. The respiratory protection device of claim 1, wherein the valve assembly comprises first and second sealing surfaces and the first and second inhalation ports comprise corresponding sealing surfaces, and in the closed configuration the first sealing surface of the valve assembly contacts the sealing surface of the first inhalation port and the second sealing surface of the valve assembly contacts the sealing surface of the second inhalation port.

10. The respiratory protection device of claim 1, wherein the actuator comprises a button, and the button is depressed when the valve assembly is in the closed configuration.

11. The respiratory protection device of claim 1, wherein the valve assembly is biased towards the open configuration.

12. The respiratory protection device of claim 1, wherein the valve assembly comprises first and second sealing surfaces.

13. The respiratory protection device of claim 12, wherein the first and second sealing surfaces are configured to move linearly between the open and closed configurations.

14. A method of operating a respiratory protection device, comprising:

operating a valve assembly from an open configuration, in which a mask body provides a first flow path through a first chamber between a first breathing air source component and a breathable air zone and a second flow path through a second chamber between a second breathing air source component and the breathable air zone, to a closed configuration in which fluid communication through the first and second flow paths is prevented;

wherein the first chamber is not in fluid communication with the second chamber, and the valve assembly comprises a single actuator movable from the open configuration to the closed configuration.

15. The method of claim 14, comprising inhaling while the valve assembly is in the closed configuration.

16. The method of claim 15, comprising assessing a fit of the mask body based on an indication observed while inhaling.

17. The method of claim 16, wherein the indication is increased difficulty inhaling.

18. The method of claim 16, wherein the mask body comprises a compliant face contacting portion and the indication is an inward deflection of the compliant face contacting portion.

19. The method of claim 14, comprising releasing the actuator to allow the valve assembly to return to the open configuration.

20. A respiratory protection device, comprising:

a mask body defining a first chamber, a second chamber, and a breathable air zone for a wearer;

first and second breathing air source components configured for attachment to the mask body such that the first chamber is in fluid communication with the first breathing air source component and the second chamber is in fluid communication with the second breathing air source component; and a valve assembly comprising a single actuator operable between an open configuration and a closed configuration in which fluid communication between the first breathing air source component and the breathable air zone is prevented;

wherein the first and second chambers are fluidically isolated such that the first chamber is in fluid communication with the breathable air zone through a first inhalation port and the second chamber is in fluid communication with the breathable air zone through a second inhalation port.

* * * * *